US009724272B2

(12) United States Patent
Röhrig

(10) Patent No.: US 9,724,272 B2
(45) Date of Patent: Aug. 8, 2017

(54) TEAT

(75) Inventor: Peter Röhrig, Vienna (AT)

(73) Assignee: BAMED AG, Wollerau (CH)

( * ) Notice: Subject to any disclaimer, the term of this patent is extended or adjusted under 35 U.S.C. 154(b) by 273 days.

(21) Appl. No.: 10/828,118

(22) Filed: Apr. 20, 2004

(65) Prior Publication Data

US 2004/0220618 A1 Nov. 4, 2004

(30) Foreign Application Priority Data

Apr. 29, 2003 (AT) ..... GM298/2003
Oct. 23, 2003 (AT) ..... GM734/2003

(51) Int. Cl.
*A61J 11/00* (2006.01)
*A61J 11/02* (2006.01)

(52) U.S. Cl.
CPC ..... *A61J 11/02* (2013.01); *A61J 11/005* (2013.01); *A61J 11/006* (2013.01); *A61J 11/0035* (2013.01); *A61J 11/0065* (2013.01)

(58) Field of Classification Search
CPC .... A61J 11/001; A61J 11/0035; A61J 11/005; A61J 17/00; A61J 17/001
USPC ..... 606/234–236; D24/194–198; 215/11.1–11.6
See application file for complete search history.

(56) References Cited

U.S. PATENT DOCUMENTS

| | | | | |
|---|---|---|---|---|
| 1,902,433 | A | 7/1931 | Brown | |
| 2,366,214 | A | 1/1945 | Ramaker | |
| 2,517,457 | A | 8/1950 | Allen | |
| 3,825,014 | A * | 7/1974 | Wroten | 606/236 |
| 4,505,398 | A * | 3/1985 | Kesselring | 215/11.5 |
| 4,613,050 | A | 9/1986 | Atkin et al. | |
| 4,623,069 | A | 11/1986 | White | |
| 5,004,473 | A * | 4/1991 | Kalantar | 606/234 |
| 5,108,686 | A * | 4/1992 | Griffin | 264/222 |
| 5,544,766 | A * | 8/1996 | Dunn et al. | 215/11.1 |
| 5,938,053 | A | 8/1999 | Verbovszky | |
| 6,161,710 | A | 12/2000 | Dieringer et al. | |
| 6,241,110 | B1 * | 6/2001 | Hakim | 215/11.1 |
| 6,699,264 | B1 * | 3/2004 | Rohrig | 606/234 |
| 6,968,964 | B2 * | 11/2005 | Gilmore | 215/11.1 |
| 7,122,045 | B2 | 10/2006 | Randolph et al. | |
| 2003/0093121 | A1 * | 5/2003 | Randolph | 606/236 |
| 2003/0181947 | A1 * | 9/2003 | Struckmeier et al. | 606/234 |
| 2005/0035078 | A1 | 2/2005 | Lieberman et al. | |
| 2005/0277987 | A1 | 12/2005 | Randolph et al. | |

FOREIGN PATENT DOCUMENTS

| | | |
|---|---|---|
| AT | 408185 | 2/2001 |
| AT | 408 185 | 9/2001 |
| AT | 408185 | 9/2001 |
| DE | 466541 | 7/1930 |
| DE | 1 886 610 | 1/1964 |
| DE | 4418604 | 12/1994 |

(Continued)

*Primary Examiner* — Katherine Rodjom
(74) *Attorney, Agent, or Firm* — Greenblum & Bernstein, P.L.C.

(57) ABSTRACT

A teat (1, 1', 1") comprising at least a shaft (4) and a nipple (2), wherein structured surface areas are provided at least in a partial region thereof, and the structured surface areas are formed by at least one rough surface zone (7) having a surface roughness of 100 μm at the most, in particular of 50 μm at the most.

47 Claims, 5 Drawing Sheets

(56) References Cited

FOREIGN PATENT DOCUMENTS

| | | |
|---|---|---|
| DE | 19716534 | 11/1997 |
| DE | 201 00 392 | 3/2001 |
| DE | 202 19 950 | 3/2003 |
| EP | 1275366 | 1/2003 |
| GB | 639628 | 7/1950 |
| GB | 968698 | 9/1964 |
| WO | WO01/00136 | 1/2001 |

* cited by examiner

TEAT

FIELD OF THE INVENTION

The invention relates to a teat comprising at least one shaft and a nipple, wherein structured surface areas are provided at least in a partial region thereof.

BACKGROUND ART

In known teats, structured surface areas are formed by thickened material portions, i.e. projections, or depressions, respectively, between the projections, wherein particularly ribs, nodules or also honeycomb-like structures are known, cf. e.g. U.S. Pat. No. 6,241,110 B1, DE 32 41 845 A1, U.S. Pat. No. 2,366,214 A and AT 408 185 B. Generally, these projections, or depressions, respectively, are provided around the teat, and they should be of help during teething, provide saliva-flow-channels or imitate a mother's breast so as to provide for a pleasant sucking sensation during drinking in case of feeding bottle teats for infants, cf. in this context also DE 466 541 C or also DE 197 16 534A; in the latter one, particularly ledge-shaped or winding elevations have been described which each are preferably formed on a broadside of the cross-sectionally oval nipple of the teat.

However, the known teats imitate a mother's breast only very insufficiently, since the projections result in an excessive structuring so that a similarity with a mother's breast with a view to the surface structure is not really achieved. Moreover, the comparatively highly structured surface, in particular ribs, nodules and the like projections have the undesired effect of providing an excessive stiffening of the teat in the region in question. In practice, this has the consequence that particularly soft materials are used for producing the teat so as to compensate for the undesired stiffness, which in turn causes an insufficient strength of the teat in the remaining regions.

SUMMARY OF THE INVENTION

It is an object of this invention to provide a teat of the type as defined above which provides as close an imitation of a mother's breast as possible while nevertheless guaranteeing the required strength or stiffness of the teat without having to put up with a regionally excessive strength and which, in particular, regionally resembles the skin as closely as possible.

According to the present invention, the teat has surface structures which are formed by at least one rough surface zone having a surface roughness of 100 μm at the most, in particular of 50 μm at the most. By the roughness of the surface of the teat being in the range of several 10 μm, a soft, skin-like appearance is not only already optically conveyed, in these regions the teat also feels like skin, comparable to a mother's breast, and particularly soft. Tests have shown that it is particularly suitable if the rough surface zone has a surface roughness of from approximately 10 μm to 40 μm, preferably from 15 μm to 30 μm.

It is also advantageous if the rough surface zone is substantially triangular in perspective view. In this embodiment, the rough zone may triangularly extend towards the nipple or tip of the nipple, respectively, and when drinking, in case of a teat for a feeding bottle, or when sucking, in case of a teat for a pacifier, the tongue which then gets into contact with this surface resembling a mother's breast will be efficiently stimulated thereby. Accordingly, advantageously the rough surface zone extends at least partially into the nipple.

For reasons of hygiene it is, moreover, suitable if several rough surface zones are provided which are separated from one another by transparent zones. Through the transparent zones or regions, soiling etc. in the interior of the teat (feeding bottle teat or pacifier teat) can immediately be detected, even in the region on the inner side of the rough surface zones, just as well as any possible lumps forming in milk or the like in case of a feeding bottle teat.

The rough design of the surface in the aforementioned zones makes it seem somewhat softer (gives a softer feel) in these zones as compared to the remaining regions of the teat, where the surface is smooth, and in order to prevent an undesired pressing together or collapsing of the teat in the region of these rough surface zones, it is also advantageous if the rough surface zone is reinforced by at least one stiffening rib. To avoid undesired elevations on the outer side of the teat, it is furthermore preferred if the stiffening rib is provided in the region of the rough surface zone on the inner side of the teat. Also with regard to the preferred extension of the rough surface zone as far as into the nipple it is suitable if the stiffening rib extends at least partially into the nipple.

Preferably, the nipple has a substantially oval cross-section, whereas the shaft has a circular cross-section. By this, the teat can comfortably be taken into the child's mouth only in two defined positions, and this also has the effect that in this case the rough surface zones can be provided at precisely defined sites on the teat. Accordingly, it is furthermore suitable if two diametrically oppositely located rough surface zones are provided. Moreover, it is advantageously provided the two rough surface zones are located in the region of the flatter sides of the nipple.

In order to allow for a reliable accommodation of the teat in the oral cavity, for designing the teat as a pacifier teat it is of advantage if the teat is configured with a nipple which has a cross-sectional area larger than the cross-sectional area of the shaft.

On the other hand, when designing the teat as a feeding bottle teat, it is suitable for imitating feeding from a mother's breast as closely as possible if the teat is configured with a lip abutment region connecting the shaft and the nipple, the rough surface zone being provided in the lip abutment region.

To simulate the child's sucking at a mother's natural breast, it is furthermore suitable if the wall thickness of the shaft is larger than the wall thickness of the nipple in the lip abutment region and in the region of the nipple. By configuring the teat with differing wall thicknesses, there results a comparatively solid base by the shaft of greater wall thickness which resiliently carries the remaining teat, i.e. the lip abutment region and the following nipple, largely imitating the feel of lying at a mother's natural breast. For, so far, the babies' intake of food via conventional feeding bottle teats has clearly been different from feeding at mother's breast. At a mother's breast, the extremely soft nipple is almost exclusively stripped by the baby's tongue and palate, and since this does not cause any negative pressure (vacuum) in the mother's breast, a completely uniform drinking is possible. In particular, none or merely a slight vacuum is employed by the baby itself so as to get the milk into his/her mouth and then swallow it. Drinking practically corresponds to the drinking from a cup, with an additional stripping.

Conventional feeding bottle teats with relatively high wall strengths are comparatively stiff and hard. Such a stiff feeding bottle teat, however, does not allow for a stripping, whereby the child receives the milk and also the unintended air practically merely by sucking. There, a negative pressure forms within the bottle already with the first sucking, which is counteracted by the baby by producing a stronger vacuum (sucking). This manner of sucking will then have as a consequence that also air is sucked and swallowed from the cavity of the mouth. This air then will lead to the extremely uncomfortable colics which are stressful for mother and child.

Tests have shown that the natural breast of a mother is particularly closely simulated if the shaft substantially has a wall thickness of from 2.00 mm to 2.50 mm, in particular of 2.25 mm, and the nipple and the lip abutment region, respectively, substantially have a wall thickness of from 1.20 mm to 1.50 mm, in particular of 1.35 mm.

To facilitate the child's above-described stripping on the teat, it is, moreover, advantageous if within the lip abutment region, at least one zone having a wall thickness lower than the wall thickness of the remaining lip abutment region is provided. Here, again, tests have shown that for the aforementioned stripping by the baby it is particularly advantageous if the zone substantially has a wall thickness of from 1.30 mm to 1.60 mm, in particular of 1.45 mm.

If the zone of reduced wall thickness extends as far as into the nipple, the zone of reduced wall thickness is provided in the entire abutment region of the child's mouth or tongue, respectively, thereby further facilitating stripping by the child. There, it is suitable that the zone is substantially triangular in an elevational view. Therefore, in this embodiment, in which the zone of reduced wall thickness extends into the nipple, a combination of an least a lower extent of the nipple and at least an upper extent of the lip abutment region, but not the shaft, can be said to constitute at least one baby-mouth-and-palate-stripping portion of the teat.

In order to avoid an undesired pressing together or collapsing of the teat in the region of the zones of reduced wall thickness, it is suitable if the zone of reduced wall thickness is reinforced by at least one stiffening rib.

To avoid undesired elevations on the outside of the teat, it is preferred if the stiffening rib in the region of the zone of reduced wall thickness is provided on the inner side of the teat.

Particularly in connection with the preferred extension of the zone of reduced wall thickness into the nipple, it is suitable if the stiffening rib extends as far as into the nipple.

If the nipple has a substantially oval cross-section, whereas the shaft has a circular cross-section, the teat can comfortably be taken into the child's mouth only in two defined positions, and consequently the zones of reduced wall thickness can be provided at precisely defined locations on the teat. Accordingly, it is further suitable if two diametrically oppositely located zones of reduced wall thickness are provided. Furthermore, in this connection it is suitable if the two zones of reduced wall thickness are located in the region of the flatter sides of the nipple.

If the rough surface zone and the zone of reduced wall thickness are arranged so as to at least partially overlap, this will result in a partial region of the teat to be formed comparatively yielding and skin-like so that a close imitation of a mother's breast is achieved.

For a particularly close simulation of the surface quality as well as the firmness of a mother's natural breast it is advantageous if the zone of reduced wall thickness is provided in a partial region of the rough surface zone.

Preferably, the teat is provided as an injection-molded member, with the rough surface zones of the teat being produced by correspondingly rough regions in the injection mold. These rough regions may, e.g., be produced by spark erosion or by chemical etching of the mold surfaces of the injection mold.

Preferably, the teat is made of a thermoplastic elastomer or of silicone, latex or the like elastomer material.

It goes without saying that the teat may also have a nipple of circular cross-section, and in case of a "bent up" so-called "one-sided" configuration of the teat nipple it is also conceivable—with a single correct position within the mouth provided thereby—to provide a rough surface zone on one side only, the lower side of the teat, in the lip abutment region and nipple region.

It should also be mentioned that nowadays an essential problem consists in that breast-feeding of the child and, thus, feeding with breast milk for the first 6 months is almost a must for health reasons, on the one hand, yet mothers in many instances cannot breast-feed the children every 4-6 hours because they are not in the child's vicinity, on the other hand. Particularly in the U.S.A., mothers often have to appear on their job again already 6 weeks after having given birth.

Now, mothers try to pump off milk by means of breast pumps, which milk will then be fed to the children in a bottle by someone else, in the mothers' absence. Thus, the children must practically switch daily between feeding bottle teat and mother's breast, which very often leads to great problems with many of these children who are only a few weeks of age. In most instances, the mother must wean the child and feed the child artificial food. This is absolutely undesirable from the medical viewpoint. American pediatricians even officially recommend breastfeeding of children until their first birthday, giving rise to enormous technical problems, as already mentioned above. By providing as small a suction opening in the feeding bottle teat as possible it is being attempted to accustom the child to one and the same suction performance and effort as when sucking on a mother's breast, yet in many instances this has proved to be not enough. Both, the "taste" and also the stickiness of rubber or silicone teats is completely different from the feel which the child gets at a mother's breast. Also the manner of sucking milk from a feeding bottle teat is completely different from the drinking movement at a mother's breast.

By the changes in the wall thickness discussed in detail here, the quite essential surface design by roughness, and the special adaptation of these properties, a large step is taken in the direction towards "a mother's breast", and mothers are allowed a substantially longer period of breastfeeding.

SHORT DESCRIPTION OF THE DRAWINGS

In the following, the invention will be explained in more detail by way of preferred exemplary embodiments illustrated in the drawings to which, however, it shall not be restricted. In detail, in the drawings, FIG. 1 shows a perspective view of a feeding bottle teat according to the invention;

DECRIPTION OF PREFERRED EMBODIMENTS

Figure 2:
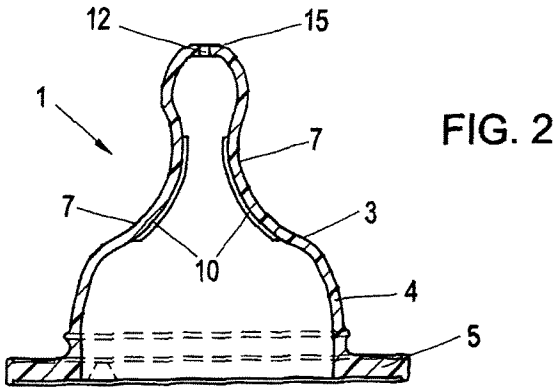
FIG. 2 shows a view of the feeding bottle teat according to FIG. 1.
Figure 3:
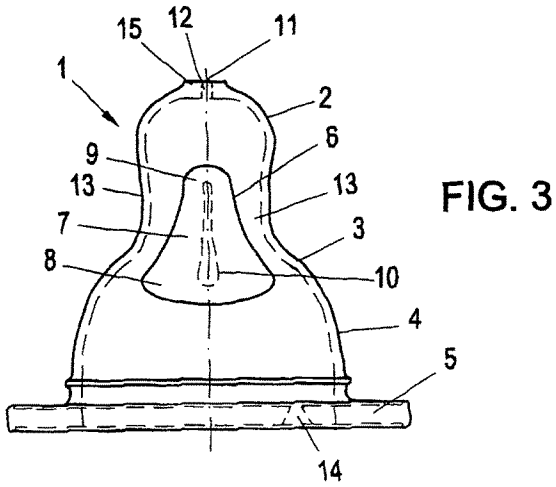
FIG. 3 shows a schematic longitudinal section through this feeding bottle teat according to FIGS. 1 and 2.
Figure 1:
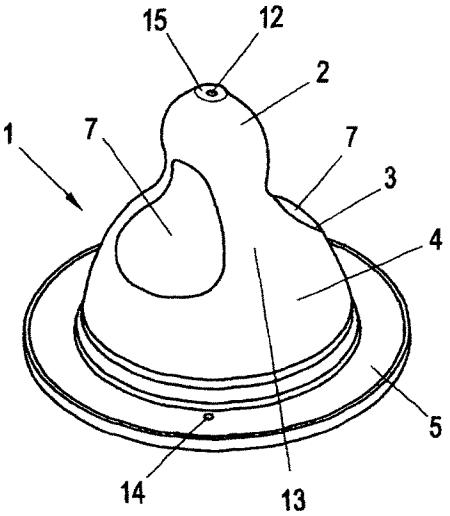

In FIGS. 1 to 3, a teat 1 in the form of a feeding bottle teat presently considered as most preferred embodiment is shown which in a per se conventional manner comprises a nipple 2, a consecutive lip abutment region 3 which merges continuously into a shaft 4 and, finally, a teat flange 5 for clamping the teat 1 on a bottle neck of a feeding bottle with the help of a screw cap, as is well known per se and not illustrated. As shown in FIG. 2, for example, the teat 1 includes an outer surface extending downwardly within the nipple 2 through an outer concave region, through a circumferential inflexion region, and through an outer convex region. In the region of its shaft 4 and the flange 5, the teat 1 has a rotation-symmetrical design, i.e., its cross-section is circular, yet the nipple 2 has an oval cross-section so that it can be comfortably taken into the infant's mouth in two positions only, i.e. with the longer axis in transverse direction. In the lip-abutment region 3, the cross-sectional shape continuously merges from the oval shape of the nipple 2 into the circular shape of the shaft 4.

On the two wide sides of the teat 1, i.e. at those sides which extend in parallel to the longer axis of the oval cross-section of nipple 2, diametrically opposite structured (textured) surface areas 6 in the form of rough surface zones 7 are provided. Seen in elevational view, as in FIG. 3, these rough surface zones 7 are approximately triangular, and they are provided such that their wider base region 8 is in the lip abutment region 3 and their narrower tip region 9 extends as far as to half of the nipple 2.

At the inner side of teat 1, in the region of these rough surface zones 7, i.e., the opposing surface textured areas 6, stiffening ribs 10 are located which, according to a central plane 11 of teat 1, extend from bottom to top and enhance the strength of the teat 1 in the region of the rough surface zones 7. This is advantageous because on account of the surface roughness in zones 7, the softness of the teat 1 increases so that-also when using an appropriately soft material for teat 1-the teat 1 could unintentionally become extremely depressed in this lip abutment region 3 when the teat 1 is used. That is, these textured surface zones 7, that is, the so-called baby-mouth-and-palate-stripping portions of the teat, are soft zones that simulate the corresponding areas of a mother's breast.

Preferably, the surface roughness is approximately 100 μm at the most, in particular 50 μm at the most, and tests have shown that optimum roughness depths range between 10 μm and 40 μm, preferably between 15 μm and 30 μm. Such values for the roughness depths result in an optimum imitation of a mother's breast.

When producing the teat 1, these surface roughnesses are obtained, e.g. during injection molding, in that the mold used during the production, in particular an injection mold, is surface-roughened by spark erosion or by chemical etching at the respective areas where the zones 7 are produced.

By the triangular shape of the zones 7 with the triangle tip pointing towards the tip of the teat, where a feeding opening 12 is provided in a conventional manner, it is ensured that, during drinking, also the infant's tongue will get into contact with this roughened zone 7 which is similar to a mother's breast, and is stimulated thereby.

As has been mentioned, the area in question of the teat is stiffened by the stiffening ribs 10 so that it cannot "collapse" during drinking and thereby cannot block the continued flow of the drinking liquid, in particular milk.

For hygiene purposes, not the entire surface of the teat is roughened, much rather, as illustrated, preferably two diametrically oppositely located rough surface zones 7 are provided, and at least in the regions 13 between these rough surface zones 7, preferably in the entire remaining region of the teat 1 outside of the rough surface zones 7, the teat 1 is designed to be transparent, having a smooth surface, so that soilings, the formation of lumps and the like will immediately be visible from the outside.

Accordingly, a thermoplastic elastomer or a latex or silicone material is preferably used as the material for the teat 1, which is translucent or transparent and which is also suitable for a production by injection molding.

Figure 4:
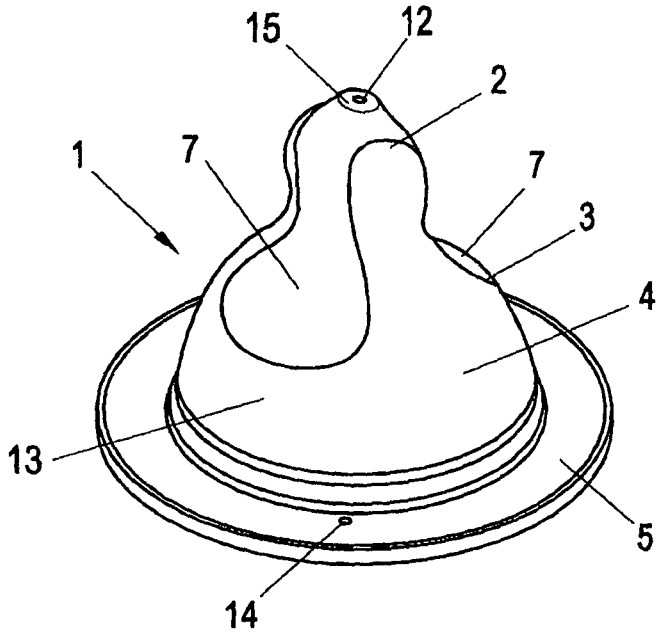
FIG. 4 shows a perspective view of another feeding bottle teat according to the invention.
Figure 5:
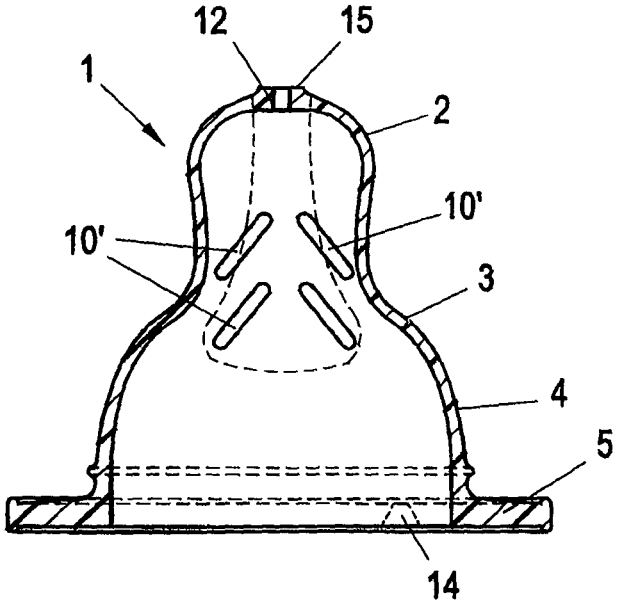
FIG. 5 shows a schematic section through this feeding bottle teat according to FIG. 4, illustrating an inclined arrangement of stiffening ribs in the interior of this feeding bottle teat.

In FIGS. 4 and 5, a somewhat modified teat 1 in the form of a feeding bottle teat is illustrated, which also comprises a nipple 2, a lip abutment region 3, a shaft 4 and a teat flange 5, wherein again the teat 1 is provided with rough surface zones 7 on two diametrically opposite sides, the flatter sides or broadsides of the teat 1 relative to the longer axis of the nipple 2 which, again, is oval in cross-section. In the remaining region 13, the teat again is designed to be transparent or translucent and smooth. However, in contrast to the exemplary embodiment according to FIGS. 1 to 3, in the embodiment according to FIGS. 4 and 5 the rough surface zones 7 extend over the upper side of the nipple 2, thereby forming a continuous rough surface region 7-7. Furthermore, it is visible from FIG. 5 that 2×2 reinforcing ribs 10' are obliquely arranged on the inner side of the teat 1 so as to again avoid an undesired collapsing or pressing together of the teat 1 in this critical region of the transition from nipple 2 to shaft 4.

Besides, also the teat 1 according to FIGS. 4 and 5 may be produced from the materials previously mentioned in connection with the teat 1 according to FIGS. 1 to 3 and in a comparable injection molding process, using a mold with zones corresponding to the zones 7, roughened by spark erosion or by chemical etching, and the surface roughness in zones 7 again is 100 μm at the most, in particular 50 μm at the most, 10 μm to 40 μm, preferably between 15 μm and 30 μm.

From the illustrations of FIGS. 1, 2 as well as of FIG. 5 it is further visible that a per se conventional venting opening 14 may be provided in the region of the teat flange 5 so as to allow for a pressure equalization in the bottle interior during drinking by letting in air.

Furthermore, the teat 1 may be reinforced in the region of the drinking opening 12 by thickened portions 15 on the outer side as well as on the inner side so as to ensure an increased strength on the front side of nipple 2, which is advantageous for drinking.

Figure 6:
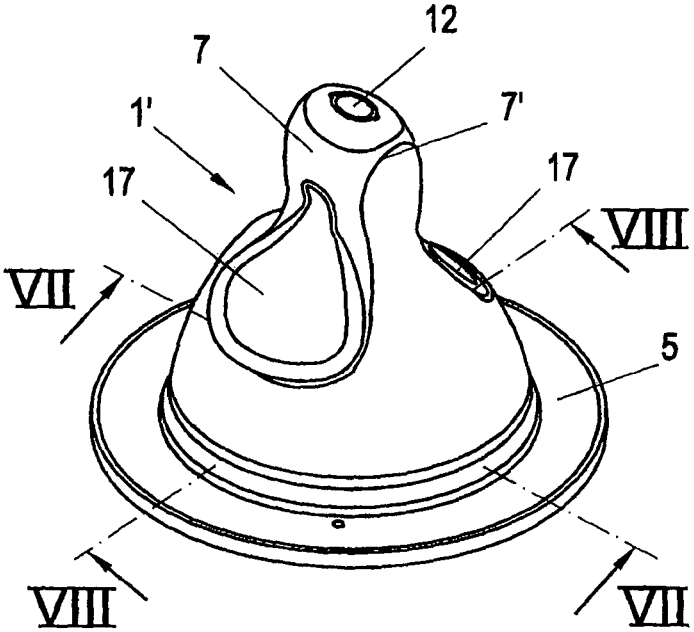
FIG. 6 shows a perspective view of a feeding bottle teat having a zone of reduced wall thickness.
Figure 7:
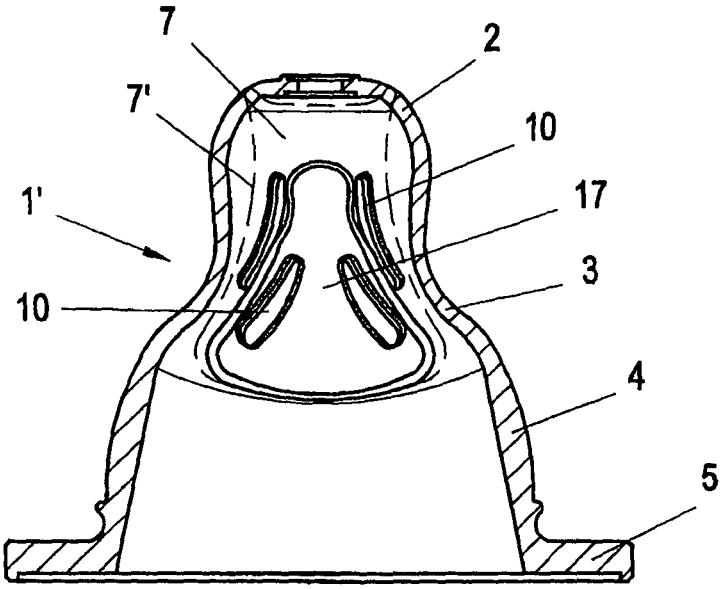
FIG. 7 shows a section according to line VII-VII of FIG. 6.
Figure 8:
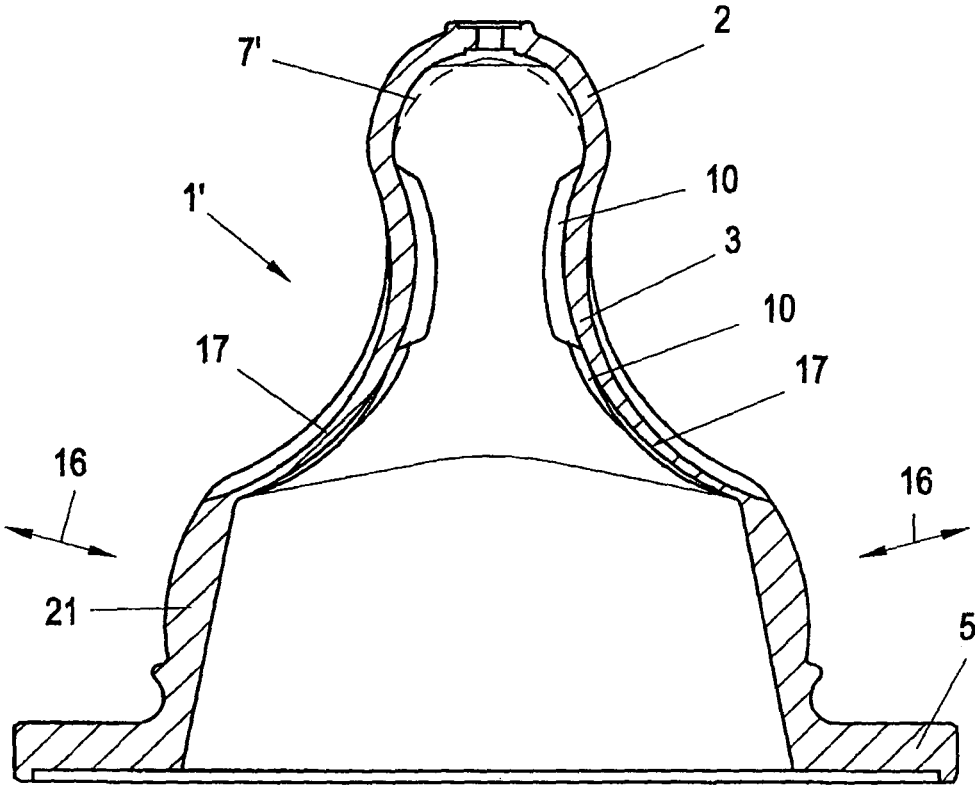
FIG. 8 shows a section according to line VIII-VIII of FIG. 6.

In FIGS. 6 to 8, an alternative exemplary embodiment of a bottle teat 1' is illustrated, in which the shaft 4 of the bottle teat 1' has a greater wall thickness than the following lip abutment region 3 as well as an adjacent nipple 2. This results in a resilience force of the shaft 4 acting in the direction of arrow 16 (cf. FIG. 8), which shaft carries the lip abutment region 3 as well as the nipple 2 of lower wall strength, said resilience allowing for a so-called stripping by the child which is a good imitation of sucking at mother's breast.

To further facilitate this stripping by the child and to simulate sucking at mother's breast, two zones 17 are provided in the lip abutment region 3 which zones—as is particularly visible in FIG. 8—have a further thinned wall thickness as compared to the remaining lip abutment region.

Just as the previously described teat 1 of uniform wall thickness, teat 1' is rotation-symmetrically designed in the region of its shaft 3, i.e. its cross-section is circular, and the nipple 2 is oval in cross-section so that it can be comfortably correctly taken into the mouth by an infant in two positions only, i.e. with the longer axis in transverse direction. In the lip abutment region 3, the cross-sectional shape merges from the oval shape of the nipple 2 into the circular shape of shaft 4, whereby the shape of the nipple 2 corresponds to the natural shape of the mammilla as closely as possible, while a baby sucks or strips at the mammilla.

Here, the two zones 17 of reduced wall thickness are arranged to be diametrically oppositely located at the two broadsides of the teat 1', i.e. at those sides which extend in parallel to the longer axis of the oval cross-section of the nipple 2, and they are designed to be approximately triangular in elevational view so that they will extend with their broad basis region in the lip abutment region 3 and with their narrower tip region as far as into the nipple 2.

On the inner side of each zone 17, four stiffening ribs 10 are provided so as to enhance the strength of teat 1', in particular in the zones 17 of reduced wall thickness so that there will be no unintentionally strong pressing in of the teat 1' in the lip abutment region 3 even when soft materials are used for teat 1'. Thus, a collapsing of the teat 1' by which the continuous flow of drinking liquid, in particular milk, would be blocked is reliably prevented by the stiffening ribs 10.

Moreover, the surface of teat 1' has an increased surface roughness in the lip abutment region 3 as well as on the nipple 2 as compared to the remaining teat 9 so that the nature of a mother's breast can better be simulated.

In the teat 1' shown in FIGS. 6 to 8, a zone 7 which is surrounded by the contour line 7' is provided with the increased surface roughness previously described in detail of approximately 100 μm at the most, in particular of 50 μm at the most.

Figures 9, 10, 11, 12:
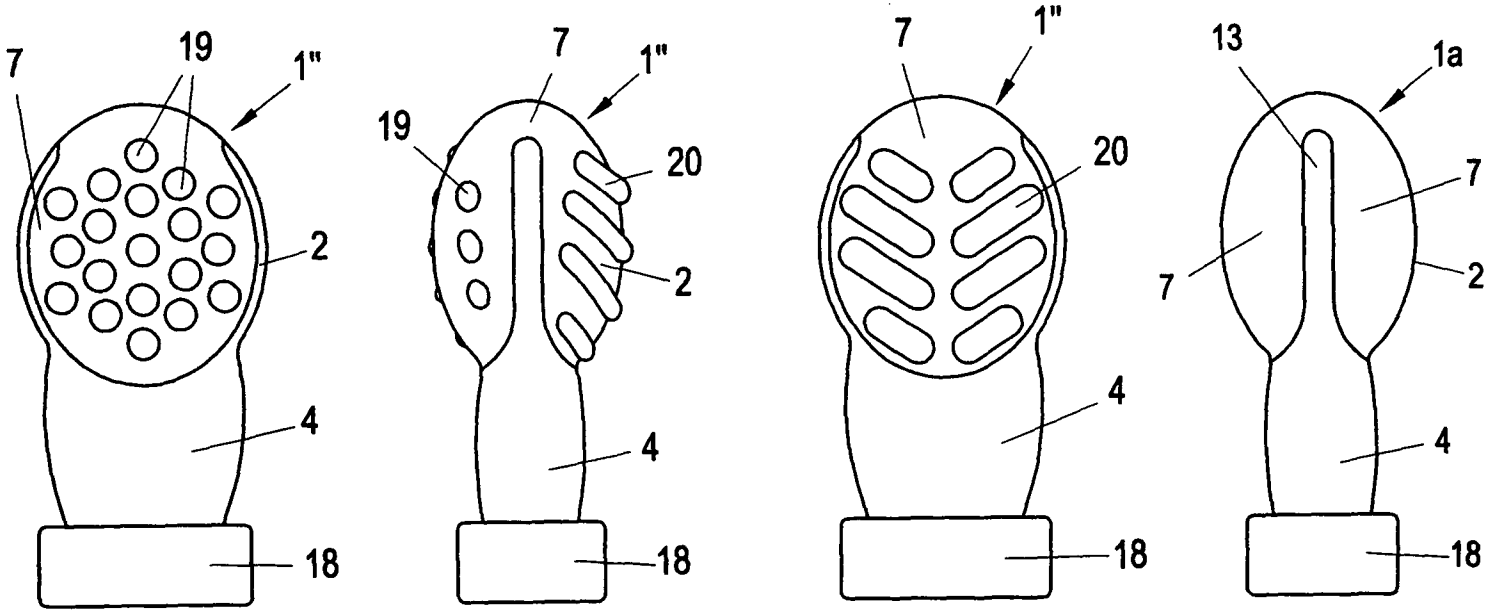
FIG. 9 shows a view of a pacifier teat with a rough surface zone in the region of the nipple.
FIG. 10 shows a side view of the pacifier teat according to FIG. 9.
FIG. 11 shows a rear view of the pacifier teat according to FIG. 9.
FIG. 12 shows a side view of a further pacifier teat with a rough surface zone.

In FIGS. 9 to 11, a pacifier teat 1" is shown as a further exemplary embodiment, in which the shaft 4 as well as the nipple 2 are designed to be oval in cross-section, with the nipple 2, however, having a larger cross-section than shaft 4 for a good accommodation in the oral cavity. At the end side, a flange 18 of larger cross-section follows shaft 4 for fastening the pacifier teat 1" in a pacifier shield (not illustrated).

For as close an imitation as possible of sucking on mother's breast, also the pacifier nipple 1" has a rough surface zone 7 provided in the region of nipple 2, which will be contacted by the baby's tongue in the functional position of the pacifier teat 1" received in the baby's mouth. In the pacifier teat 1", the rough surface zone 7 mainly extends on the diametrically oppositely located broadsides of nipple 2.

Furthermore, to imitate the natural breast of a mother, raised areas are provided on the broadsides of nipple 2 in the rough surface zone 7. In the exemplary embodiments illustrated in FIGS. 9 to 11, round nodules 19 are provided as raised areas on one broadside of nipple 2, on the other broadside fishbone-type arranged ribs 20 are provided. What is essential here, too, is mainly that a rough surface, skin-like zone 7 is provided to simulate the surface quality of the natural breast of a mother.

In FIG. 12, finally, a pacifier teat 1*a* is shown in a side view similar to FIG. 10, with a nipple 2 without raised areas, which in turn merges into a flange 18 via a shaft 4, and which has a rough surface zone 7 on both broadsides as well as on its tip; on the two narrow sides as well as on shaft 4, smooth, transparent regions 13 are provided.

What is claimed is:

1. A teat comprising:

a nipple having an apex with a feeding opening;

the nipple having a lower region, the lower region of the nipple having an outer concave surface;

a lip abutment region extending downwardly from below the nipple, the lip abutment region having an outer convex surface;

a shaft below the lip abutment region;

at least two textured surfaces, each extending above the lip abutment region and at least partially within the outer concave surface of the lower region of the nipple;

each of the at least two textured surfaces having a roughness depth of 10 μm to 50 μm;

at least two non-textured surfaces, each extending at least within the outer concave surface of the lower region of the nipple and downwardly into the outer convex surface of the lip abutment region;

the at least two textured surfaces extending circumferentially and successively around the lower region of the nipple;

the at least two non-textured surfaces extending circumferentially and successively around the lower region of the nipple; and respective ones of the at least two non-textured surfaces being circumferentially interposed between successive circumferential pairs of the at least two textured surfaces.

2. A teat according to claim 1, wherein:

each of the non-textured surfaces is smooth and has a stickiness.

3. A teat according to claim 1, wherein:

each of the at least two non-textured surfaces is a transparent surface.

4. A teat according to claim 1, wherein:

each of the at least two textured surfaces extends within the outer convex surface of the lip abutment region and upwardly at least partially into the outer concave surface of a lower region of the nipple.

5. A teat according to claim 4, wherein:

the outer convex surface of the lip abutment region does not include any outwardly projecting nodules.

6. A teat according to claim 1, wherein:

the outer convex surface of the lip abutment region does not include any outwardly projecting nodules.

7. A teat comprising:

a nipple having an apex with a feeding opening;

an outer surface extending downwardly within the nipple and continuously through an outer concave region of the nipple, through a circumferential line of inflexion, and into a convex region below the nipple;

at least one textured surface extending downwardly within the concave region, through the circumferential line of inflexion, and into the convex region;

the at least one textured surface having a roughness depth of 10 μm to 50 μm;

at least one smooth surface extending downwardly within the concave region, through the circumferential line of inflexion, and into the convex region;

the at least one textured surface extending circumferentially less than an entirety of a circumference of the teat; and the at least one textured surface circumferentially abutting a smooth surface of the at least one smooth surface.

8. A teat according to claim 7, wherein:

the at least one smooth surface consists of at least one non-textured surface.

9. A teat comprising:

a nipple;

a lip abutment region below the nipple;

a shaft below the lip abutment region;

the lip abutment region extending continuously into the shaft;

at least two textured surface zones, each having a roughness depth (Rz) of 10 μm to 50 μm;

at least two smooth surface zones, each having a stickiness;

each of the at least two textured surface zones having a greater roughness depth than a roughness depth of the at least two smooth surface zones;

each of the at least two textured surface zones having a soft, skin-like appearance and feel and a lesser stickiness than the stickiness of the at least two smooth surface zones;

the teat being transparent in each of the at least two smooth surface zones;

each of the at least two textured surface zones extending above the lip abutment region and within a length of the nipple to configure the at least two textured surface zones to be positioned to be contacted by a baby's tongue during a feeding or sucking position of the nipple received in a baby's mouth;

the at least two textured surface zones extending circumferentially and successively around the lower region of the nipple;

the at least two non-textured surface zones extending circumferentially and successively around the lower region of the nipple; and respective ones of the at least two non-textured surface zones being circumferentially interposed between successive circumferential pairs of the at least two textured surface zones.

10. A teat according to claim 9, wherein:

the teat is made of a material selected from the group consisting of a rubber or silicone that provides the at least one smooth surface zone with the stickiness; and the roughness depth of the at least two textured surface zones provides the teat, in the at least two textured surface zones, with a greater softness and the lesser stickiness than in the at least two smooth surface zones.

11. A teat according to claim 9, wherein:

the at least two textured surface zones extend above the lip abutment zone to at least half of a length of the nipple.

12. A teat according to claim 9, wherein:

the at least two textured surface zones extend above the lip abutment zone to an upper side of the nipple.

13. A teat according to claim 9, wherein:

the lip abutment region comprises an outer convex surface; and the at least two textured surface zones extend within an outer convex region of the lip abutment zone and at least within an outer concave surface of a lower region of the nipple.

14. A teat according to claim 9, wherein:

a combination of an least a lower extent of the nipple and at least an upper extent of the lip abutment region, but not the shaft, constitute at least one baby-mouth-and-palate-stripping portion of the teat; and each of said at least two textured surface zones consists of said at least one baby-mouth-and-palate-stripping portion of the teat.

15. A teat according to claim 14, wherein:

said at least one baby-mouth-and-palate-stripping portion of the teat comprises at least two baby-mouth-and-palate-stripping portions of the teat arranged diametrically opposite each other.

16. A teat according to claim 14, wherein:

said at least one baby-mouth-and-palate-stripping portion of the teat is substantially triangular.

17. A teat as set forth in claim 9, wherein each of said at least two textured surface zones has a roughness depth of from 10 μm to 40 μm.

18. A teat as set forth in claim 17, wherein each of said at least two textured surface zones has a roughness depth of from 15 μm to 30 μm.

19. A teat as set forth in claim 9, wherein each of said at least two textured surface zones is substantially triangular in perspective view.

20. A teat as set forth in claim 9, wherein said transparent zones separate said textured surface zones from each other.

21. A teat as set forth in claim 9, further comprising at least one stiffening rib reinforcing respective ones of said at least two textured surface zones.

22. A teat as set forth in claim 21, wherein each of said at least one stiffening rib is provided on an inner side of said teat.

23. A teat as set forth in claim 21, wherein said at least one stiffening rib extends at least partially into said nipple.

24. A teat as set forth in claim 9, wherein said nipple has a substantially oval cross section thereby having two flatter sides, and said shaft has a circular cross-section.

25. A teat as set forth in claim 24, wherein two of the at least two textured surface zones are arranged diametrically opposite each other on said two flatter sides of said nipple.

26. A teat as set forth in claim 9, wherein two of the at least two textured surface zones are arranged diametrically opposite each other.

27. A teat as set forth in claim 9, said teat being designed as a pacifier teat, wherein said nipple has a cross-sectional area and said shaft has a cross-sectional area, said cross-sectional area of said nipple being larger than said cross-sectional area of said shaft.

28. A teat as set forth in claim 27, further comprising a lip abutment region interconnecting said shaft and said nipple, said at least two textured surface zones being provided in said lip abutment region, and said shaft being thicker than said lip abutment region and thicker than said nipple, said lip abutment region including at least one thinner zone having a wall thickness slighter than the wall thickness of the remaining lip abutment region, said thinner zone being provided in a partial region of at least one of said at least two textured surface zones.

29. A teat as set forth in claim 9, said teat being designed as a feeding bottle teat, further comprising a lip abutment region interconnecting said shaft and said nipple, said at least two textured surface zones being provided in said lip abutment region.

30. A teat as set forth in claim 29, wherein said shaft has a certain wall thickness, said lip abutment region has a certain wall thickness, said nipple has a certain wall thickness, the wall thickness of said shaft exceeding the wall thickness of said lip abutment region and the wall thickness of said nipple.

31. A teat as set forth in claim 30, wherein the wall thickness of said shaft ranges substantially from 2.00 mm to 2.5 mm, and the wall thickness of said nipple and of said lip abutment region substantially ranges from 1.20 mm to 1.50 mm.

32. A teat as set forth in claim 31, wherein the wall thickness of said shaft is substantially 2.25 mm.

33. A teat as set forth in claim 31, wherein said wall thickness of said nipple and said wall thickness of said lip abutment region is substantially 1.35 mm.

34. A teat as set forth in claim 30, wherein said lip abutment region comprises at least one thinner zone having a wall thickness slighter than the wall thickness of the remaining lip abutment region.

35. A teat as set forth in claim 34, wherein said at least one thinner zone has a wall thickness ranging substantially from 1.30 mm and 1.60 mm.

36. A teat as set forth in claim 35, wherein said wall thickness of said at least one thinner zone is 1.45 mm.

37. A teat as set forth in claim 34, wherein said at least one thinner zone extends as far as into said nipple.

38. A teat as set forth in claim 37, wherein said at least one thinner zone is substantially triangular in perspective view.

39. A teat as set forth in claim 34, wherein said at least one thinner zone is reinforced by at least one stiffening rib.

40. A teat as set forth in claim 39, wherein said at least one stiffening rib provided in said thinner zone is located inside said teat.

41. A teat as set forth in claim 34, wherein two thinner zones are provided, said two thinner zones being provided diametrically opposite each other.

42. A teat as set forth in claim 41, wherein said nipple has a substantially oval cross section thereby having two flatter sides, and said shaft has a circular cross-section, said two thinner zones being provided in said flatter sides of said nipple.

43. A teat as set forth in claim 34, wherein at least one of said at least two textured surface zones and said at least one thinner zone are arranged so as to at least partially overlap.

44. A teat as set forth in claim 34, wherein said at least one thinner zone is provided in a partial region of at least one of said at least two textured surface zones.

45. A teat as set forth in claim 9, wherein said teat is an injection-molded teat.

46. A teat as set forth in claim 9, wherein said teat is made of a thermoplastic elastomer.

47. A teat as set forth in claim 9, wherein said teat is made of a material selected from the group consisting of latex, silicone and the like elastomer materials.

* * * * *